United States Patent [19]

Marshall

[11] 4,193,880

[45] Mar. 18, 1980

[54] APPLICATION OF FLUOROCARBON COMPOUND TO SYNTHETIC ORGANIC POLYMER YARN

[75] Inventor: Robert M. Marshall, Chester, Va.

[73] Assignee: Allied Chemical Corporation, Morris Township, Morris County, N.J.

[21] Appl. No.: 25,636

[22] Filed: Mar. 30, 1979

Related U.S. Application Data

[63] Continuation-in-part of Ser. No. 1,625, Jan. 8, 1979.

[51] Int. Cl.[2] ..... D06M 13/34

[52] U.S. Cl. ..... 252/8.8; 8/115.6; 252/8.6; 252/8.7; 428/395; 560/87

[58] Field of Search ..... 252/8.8, 8.6, 8.75; 8/115.6; 428/395; 560/87

[56] References Cited

U.S. PATENT DOCUMENTS

| | | | |
|---|---|---|---|
| 3,780,202 | 12/1973 | Marshall et al. | 252/8.7 |
| 3,997,450 | 12/1976 | Steinmiller | 252/8.8 |
| 4,007,305 | 2/1977 | Kakar et al. | 428/395 |
| 4,063,024 | 12/1977 | Sandler | 560/87 |
| 4,103,068 | 7/1978 | Marshall et al. | 428/395 |
| 4,134,839 | 1/1979 | Marshall | 252/8.6 |

*Primary Examiner*—William E. Schulz

*Attorney, Agent, or Firm*—Richard A. Anderson; Virginia S. Andrews

[57] ABSTRACT

A yarn finish composition is disclosed for incorporation with synthetic organic polymer yarn or yarn products to render the same oil repellent and resistant to soiling. The composition comprises (a) a nonhomogeneous mixture of a salt of dinonyl sulfosuccinate, a salt of dimethyl naphthalene sulfonate, and ammonium perfluoroalkyl carboxylate, and (b) a fluorochemical compound consisting of polycarboxybenzene esterified with certain partially fluorinated alcohols and with hydroxyl-containing organic radicals such as 2-hydroxyethyl, glyceryl, and chlorohydryl or bromohydryl.

16 Claims, No Drawings

APPLICATION OF FLUOROCARBON COMPOUND TO SYNTHETIC ORGANIC POLYMER YARN

CROSS-REFERENCE TO RELATED APPLICATIONS

This application is a continuation-in-part of application Ser. No. 1,625, filed Jan. 8, 1979.

BACKGROUND OF THE INVENTION

This invention relates to a yarn finish composition. More particularly, this invention relates to a yarn finish composition for incorporation with synethetic organic polymer yarn or yarn products to render the same oil repellent and resistant to soiling. This invention further relates to emulsions which include the aforementioned yarn finish composition as a component thereof.

The treatment of textiles with fluorochemicals to impart oil repellency and soil resistance has been known for some time. U.S. application Ser. No. 861,372, filed Dec. 16, 1977, discloses that polycarboxybenzenes esterfied with certain partially fluorinated alcohols and with hydroxyl-containing organic radicals such as 2-hydroxyethyl, glyceryl, and chlorohydryl or bromohydryl, when incorporated with polyethylene terephthalate or synthetic long-chain polyamide fibers as by contact in a liquid medium, concentrate at the fiber surface, especially if the fiber is annealed. A relatively durable oil and water repellency is thus imparted to the fiber. Commonly assigned U.S. Pat. No. 4,134,839 to Marshall, hereby incorporated by reference, indicates that the oil repellent fluorocarbon compounds of U.S. application Ser. No. 861,372 are not compatible with the lubricating oils in spin finishes used in a conventional spin finish, and further, that the emulsifying componenets of some known spin finishes are not suitable for preparing an oil in water emulsion containing these oil repellent fluorocarbon compounds. U.S. Pat. No. 4,134,839 discloses a spin finish which has the oily properties of a conventional spin finish and which also imparts to the yarn the oil repellent properties of the fluorocarbon finish of U.S. application Ser. No. 861,372. However, we have found that the disclosed spin finish causes serious processing problems when a finish circulating pump is utilized in the finish circulation system of a conventional spinning process, i.e., the flurocarbon separates, clogs and stops the finish circulating pump. Accordingly, extensive research has been carried out to develop an improved spin finish which possesses the desirable properties of both of the aforementioned applications and which will not gradually separate in the finish circulation system during commercial processing of the yarn. As a by-product of this research, a yarn finish composition (applied separately from the lubricating spin finish) has been discovered which, when incorporated with synthetic organic polymer yarn or yarn products, renders the same oil repellent and resistant to soiling.

SUMMARY OF THE INVENTION

The present invention provides a yarn finish composition for incorporation with synthetic organic polymer yarn or yarn products to render the same oil repellent and resistant to soiling.

The yarn finish composition of the present invention comprises (a) about 15 to 80 weight percent of a nonhomogeneous mixture of a salt of dinonyl sulfosuccinate, a salt of dimethyl naphthalene sulfonate, and ammonium perfluoroalkyl carboxylate; and (b) about 20 to 85 weight percent of a fluorochemical compound. The fluorochemical compound has the formula

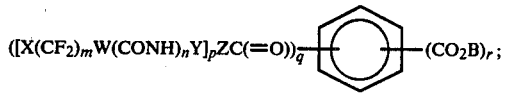

I.

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile, or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different.

The nonhomogeneous mixture forming a part of the yarn finish composition preferably consists essentially of about 20 to 60 percent by weight of the salt of dinonyl sulfosuccinate, about 5 to 23 percent by weight of the salt of dimethyl naphthalene sulfonate, and about 17 to 60 percent by weight of ammonium perfluoroalkyl carboxylate.

The yarn finish composition of the present invention can be applied in any known manner to synthetic organic polymer fiber, yarn to yarn products, e.g., by spraying the fiber, yarn to yarn products or by dipping them into or otherwise contacting them with the composition. It is preferred that an emulsion of water and approximately 5 to 25 percent by weight of the emulsion of the composition, be formed for application to the yarn or yarn products. This emulsion can be applied during spinning of the yarn with, preferably, a conventional spin finish being applied to the yarn just prior to or subsequent to application of the emulsion, e.g., by tandem (in series) kiss rolls. The emulsion can alternatively be applied as an overfinish during beaming of the yarn or at any other processing stage. Staple fiber can be treated by spraying. Further, fabric or carpet made from synthetic organic polymer yarn can be treated with the emulsion, e.g., by spraying, padding, or dipping in a conventional manner.

This invention includes also polyamide and polyester and other polymer fibers, yarns and yarn products having incorporated therewith the yarn finish composition or emulsion as above defined. The yarn finish composition of the present invention renders yarn and resistant to soiling, especially by oily materials.

Throughout the present specification and claims, the term "yarn" is employed in a general sense to indicate strand material, either textile or otherwise, and including a continuous, often plied, strand composed of fibers or filaments, or a noncontinuous strand such as staple, and the like. The term "yarn" also is meant to include fiber, such as continuous single filaments of a yarn, or individual strands of staple fiber before drafting and spinning into a conventional staple yarn. The term "yarn product" is likewise used in a general sense to indicate the end use of the yarn, and includes both fabrics used in apparel, upholstery, draperies, and similar applications, as well as carpets, either prior to or subsequent to dyeing and/or printing. The phrase "synthetic organic polymer" generally includes any fiber-forming thermoplastic resin, such as polypropylene, polyamide, polyester, polyacrylonitrile and blends thereof. The phrase "during commercial processing of the yarn" refers generally to any yarn process which utilzes a finish circulating pump in its finish circulation system.

DESCRIPTION OF THE PREFERRED EMBODIMENT

The preferred fluorochemical compounds which are useful in the yarn finish composition and emulsion of the present invention are trimellitates and pyromellitates. They can be represented by the following formulas, wherein A and A' represent the same or different radicals $X(CF_2)_mW(CONH)_n$ Y of formula I above, and wherein each A and A' radical has a main chain containing at least six carbon atoms and contains at least four perfluorinated carbon atoms in the radical. In the following formulas, B is as previously defined with Formula I above and B' is the same or different radical.

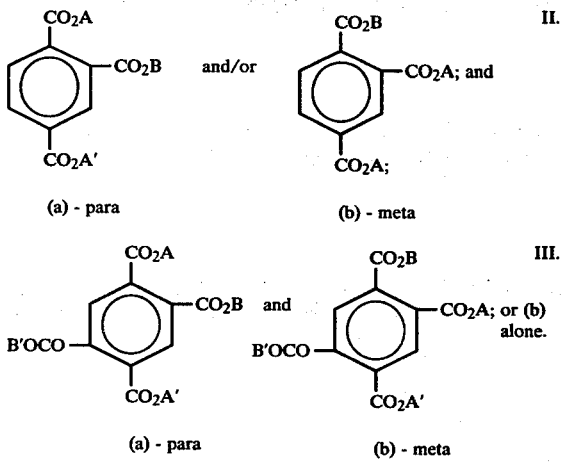

The above fluorinated radicals A, A' are likewise preferred in the various other compounds of the invention, in particular in bis(diamide)/esters of trimellitic acid and of pyromellitic acid in accordance with this invention.

Fluorochemical compounds which are more particularly preferred are mixtures of substituted pyromellitic acid or trimellitic acid position isomers, especially mixtures of the para and meta pyromellitate position isomers, represented by Formulas III (a) and (b) above, with A=A' and B=B', and A containing at least six perfluorinated carbon atoms, and not over four other chain atoms therein; especially such mixtures containing about 50:50 molar proportions of each of the two-position isomers of Formula III. The attachment of the radicals in the para isomer (see Formula III (a) above) is symmetrical with respect to rotation 180 degrees about the axis through the center of the nucleus. This isomer, used alone, shows relatively low repellency. Nevertheless, when the para isomer is mixed in about 50:50 molar ratio with the meta isomer (which is unsymmetrical with respect to rotation about such axis), the mixture shows repellency essentially equal to the good repellency of the substantially pure meta isomer used alone in the same amount. The corresponding bis(diamide)/esters of the substituted acids are likewise preferred.

It will be appreciated that although overall the radicals A and A' will both be the same and the radicals B and B' will both be the same in the preferred fluorochemical compounds, they may nevertheless vary within individual molecules because a mixture of fluorinated alcohols will generally be used to obtain the fluorinated radicals A, and because epoxides used to obtain the radicals B may react further to form dimers or higher polymers of the B radicals.

In especially preferred radicals A and A', the fluorinated moiety has the formula $CF_3(CF_2)_m$ or $(CF_3)_2CFO(CF_2)_{m'}$ where m independently at each occurrence has any integral value from 5 to 9, m' independently at each occurrence has any integral value from 2 to 16, and $(CF_2)_m$ and $(CF_2)_{m'}$ are straight chains.

Preferred radicals B and B' are $CH_2CH_2OH$, $CH_2CH(OH)CH_2Cl$, $CH_2CH(OH)CH_2OH$ and $CH_2CH(OH)CH_2Br$.

The fluorinated radicals in the fluorochemical compounds useful in this invention are provided in general by reaction between a benzene polycarboxylic acid anhydride or carboxy chloride/anhydride, which can be additionally substituted in the benzene ring, and an appropriate fluorinated alcohol or amine. The corresponding carboxylic acid/half ester containing a fluorinated esterifying radical and a carboxy group is produced from the anhydride group reacting with an alcohol; or when the compound is an amide rather than an ester, the appropriate fluorinated amine is used as reactant instead of the alcohol, with production of a fluorinated amido group and a carboxy group. All free carboxy groups can then be esterified by base-catalyzed reaction with the epoxide corresponding to the desired "B" group in the compound.

The invention will now be further described in the following specific examples which are to be regarded solely as illustrative and not as restricting the scope of the invention. In particular, although the examples are limited to polyamide and polyester yarns and yarn products, it will be appreciated that the yarn finish composition and emulsion of the present invention can be applied to yarn made from any synthetic organic polymer filaments and products thereof. Further, although the examples are limited to sodium dinonyl sulfosuccinate, the dinonyl sulfosuccinates useful in this invention are of the salts of dinonyl sulfosuccinates, especially the ammonium salt and the alkali metal, particularly sodium and potassium, salts of a dinonyl ester of sulfosuccinic acid. Likewise, while the examples are limited to dimethyl naphthalene sodium sulfonate, the dimethyl naphthalene sulfonates useful in this invention are of the salts of dimethyl naphthalene sulfonate, especially the ammonium salt and the alkali metal, particularly sodium and potassium, salts of dimethyl naphthalene sulfonate. In the following examples, parts and percentages employed are by weight unless otherwise indicated.

EXAMPLE 1

The fluorochemical used in this example was a mixture of pyromellitates having the following structure:

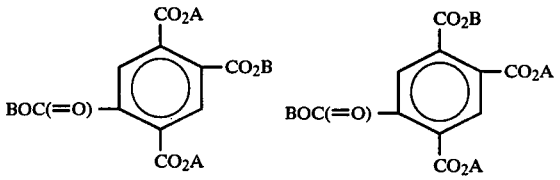

(a) para (50%) (b) meta (50%)

A = $(CH_2)_2(CF_2)_n CF_3$
where n is 5–13
B = $CH_2CHOHCH_2Cl$

For convenience, this mixture of pyromellitates is hereinafter called Fluorochemical Composition-1. About 46.3 parts of Fluorochemical Composition-1 were added to 53.7 parts of a nonhomogeneous mixture which consisted essentially of about 41.3 percent by weight of Nekal WS-25, about 17.4 percent by weight of dimethyl naphthalene sodium sulfonate and about 41.3 percent by weight of ammonium perfluoroalkyl carboxylate. Nekal WS-25 is General Aniline and Film Corporation's trade name for a solution of 75 percent by weight sodium dinonyl sulfosuccinate, 10 percent by weight isopropanol, and 15 percent by weight water. The ammonium perfluoroalkyl carboxylate is manufactured under the trade name of FC-143 and obtainable from the 3M Company, Chemical Division, 900 Bush Avenue, St. Paul, Minnesota. The Fluorochemical Composition-1 and mixture were heated to 80° C., at which temperature the Fluorochemical Composition-1 melted and formed a clear homogeneous first noncontinuous phase. It is believed that the isopropanol vaporized, and is not present in the final composition. This first noncontinuous phase was then added to 800 parts of water heated to about 80° C., and the mixture was agitated to form an emulsion, which was then cooled to about 60° C. The oil particles in this emulsion had a particle size of less than one micron, and the emulsion was stable for at least 30 days without signs of separation. For convenience, this emulsion is called Emulsion-1.

It should be noted that in forming Emulsion-1 or the first noncontinuous phase above, Fluorochemical Composition-1 and the solution can be heated to a temperature of between approximately 75° C. and 90° C. The temperature of the water should correspond approximately to that of the first noncontinuous phase when it is added to the water. The resultant emulsion can be cooled to a temperature between approximately 50° C. and 70° C.

To Emulsion-1 was added 100 parts of a second noncontinuous phase consisting essentially of about 55 percent by weight of coconut oil, about 25 percent by weight of polyoxyethylene oleyl ether containing about 10 moles of ethylene oxide per mole of oleyl alcohol, about 5 percent by weight of polyoxyethylene nonyl phenol containing about 9 moles of ethylene oxide per mole of nonyl phenol, and about 15 pecent by weight of polyoxyethylene stearate containing about 8 moles of ethylene oxide per mole of stearic acid. The resulting emulsion was stable for at least 30 days and was suitable for use as a spin finish as described hereinafter. For convenience, this emulsion is called Spin Finish-1.

EXAMPLE 2

The procedure of Example 1 is followed except that 46.3 parts of Fluorochemical Composition-1, 53.7 parts of the mixture, and 400 parts of water are used to form an emulsion, which is called Emulsion-2. The oil particles in this emulsion have a particle size of less than one micron, and the emulsion is stable for at least 30 days without signs of separation.

Emulsion-2 is then blended with 500 parts of another oil in water emulsion containing 20 percent of an oil composition consisting essentially of about 55 percent by weight of coconut oil, about 25 percent by weight of polyoxyethylene oleyl ether containing about 10 moles of ethylene oxide per mole of oleyl alcohol, about 5 percent by weight of polyoxyethylene nonyl phenol containing about 9 moles of ethylene oxide per mole of nonyl phenol, and about 15 percent by weight of polyoxyethylene stearate containing about 8 moles of ethylene oxide per mole of stearic acid. The resulting emulsion is stable for at least 30 days and is suitable for use as a spin finish as described hereinafter. For convenience, this emulsion is called Spin Finish-2. Spin Finish-1 and Spin Finish-2 may be used in the same manner to coat yarn during or subsequent to spinning.

EXAMPLE 3

This example demonstrates use of Spin Finish-1 in a conventional spin-draw process for production of a polyamide yarn suitable for processing into bulked yarn that is oil repellent and resistant to soiling, especially by oily materials.

A typical procedure for obtaining polymer pellets for use in this example is as follows. A reactor equipped with a heater and stirrer is charged with a mixture of 1,520 parts of epsilon-caprolactam and 80 parts of aminocaproic acid. The mixture is then flushed with nitrogen and stirred and heated to 255° C. over a one-hour period at atmospheric pressure to produce a polymerization reaction. The heating and stirring is continued at atmospheric pressure under a nitrogen sweep for an additional four hours in order to complete the polymerization. Nitrogen is then admitted to the reactor and a small pressure is maintained while the polycaproamide polymer is extruded from the reactor in the form of a polymer ribbon. The polymer ribbon is subsequently cooled, pelletized, washed and dried. The polymer is a white solid having a relative viscosity of about 50 to 60 as determined at a concentration of 11 grams of polymer in 100 ml. of 90 percent formic acid at 25° C. (ASTM D-789-62T).

Polyamide polymer pellets prepared in accordance, generally, with the procedure above were melted at about 285° C. and melt extruded under pressure of about 1,500 psig. through a 70-orifice spinnerette to produce an undrawn yarn having about 3,600 denier. Spin Finish-1 of Example 1 was applied to the yarn as a spin finish in amount to provide about 1.0 percent by weight of oil on the yarn. The yarn was then drawn at about 3.2 times the extruded length and textured with a steam jet at a temperature of 140° C. to 180° C. to produce a bulked yarn that is particularly useful for production of carpets and upholstery fabrics.

In the finish circulation system, a finish circulating pump pumped Spin Finish-1 from a supply tank into a tray in which a kiss roll turned to pick up finish for application to the moving yarn in contact with the kiss roll. Finish from the tray overflowed into the supply tank. There was no separation of Spin Finish-1 in the finish circulation system.

The bulked yarn was visually inspected for mechanical quality after spinning and steam jet texturing. The visual inspection sighting was perpendicular to the wraps of yarn on a tube forming a yarn package. The rating was from 1 to 5 wherein 5 was excellent and represented no visible broken filaments, wherein 1 was poor and represented a fuzzy appearance due to a large number of broken filaments, and wherein 4 through 2 represented increasing numbers of broken filaments. Bulked yarn made in accordance with this example had a mechanical quality rating of 4.

The bulked yarn was made into a fabric by conventional means and evaluated for oil repellency by AATCC Test No. 118-1975 which involved wetting the fabric by a selected series of liquid hydrocarbons of different surface tensions. The test liquids were as follows:

| Oil Repellency Rating Number | Test Liquid |
|---|---|
| 1 | "Nujol" |
| 2 | 65:35 "Nujol" n-hexadecane by volume |
| 3 | n-Hexadecane |
| 4 | n-Tetradecane |
| 5 | n-Dodecane |
| 6 | n-Decane |
| 7 | n-Octane |
| 8 | n-Heptane |

"Nujol" is the trademark of Plough, Inc. for a mineral oil having a Saybolt viscosity 360/390 at 38° C. and a specific gravity 0.880/0.900 at 15° C.

In the test, one test specimen, approximately 20 ×20 cm., was conditioned for a minimum of four hours at 21±1° C. and 65±2 percent relative humidity prior to testing. The test specimen was then placed on a smooth, horizontal surface and, beginning with the lowest numbered test liquid, a small drop — approximately 5 mm. in diameter (0.05 ml. volume) — was placed with a dropping bottle pipette on the test specimen in several locations. The drop was observed for 30 seconds at an angle of approximately 45 degrees.

If no penetration or wetting of the fabric at the liquid-fabric interface and no wicking around the drop occurred, a drop of the next higher-numbered test liquid was placed at a site adjacent on the fabric to the first drop, again observing the drop for 30 seconds. This procedure was continued until one of the test liquids showed obvious wetting of the fabric under or around the drop within 30 seconds.

The fabric made from polyamide yarn prepared in accordance with the present example had an oil repellency of 5–6.

EXAMPLE 4

There are three stages at which emulsion stability was measured. The first stage was after the initial oil in water emulsion was formed with Fluorochemical Composition-1. The second stage was after the second emulsion, optionally aqeous, had been added to the initial oil in water emulsion. And the third stage occurred during processing of the yarn when the spin finish was in a finish circulation system which utilized a finish circulating pump.

This example illustrates the importance of the particular emulsifier chosen with respect to the first step, i.e., the stability of the initial oil in water emulsion formed with Fluorochemical Composition-1. Table I lists the formulations tested for emulsion stability, eight of which (formulations A, B, C, D, E, F, G and H) exhibited excellent emulsion stability after 72 hours. As will be shown by later examples, these same formulations (A, B, C, D, E, F, G and H) showed excellent emulsion stability at the second measured stage depending on the choice of the second emulsion. At the third measured stage, however, only spin finishes incorporating formulations A, F, G, and H showed excellent emulsion stability, while spin finishes incorporating formulatons B, C, D and E gradually separated. Formulations F, G and H are the subject of a separate, commonly assigned patent application.

With the exception of formulation E, all of the formulations (A through V) had as one of their constituents a sulfosuccinate diester. With respect to this group of formulations, it can be seen that the sodium dinonyl sulfosuccinate, dimethyl naphthalene sodium sulfonate and ammonium perfluoroalkyl carboxylate comprising the nonhomogeneous mixture of Example 1 and a part of formulations A, B, C and D were apparently all necessary to the stable emulsification of Fluorochemcial Composition-1. This is highlighted by a comparison of formulations A and B (of the present invention) with formulation I, (necessity of sodium dinonyl sulfosuccinate), and by a comparison of formulations A and B with formulations J and S (necessity of dimethyl naphthalene sodium sulfonate and ammonium perfluoroalkyl carboxylate). Especially worthy of note is the noninterchangeability of sodium dinonyl sulfosuccinate and sodium dioctyl sulfosuccinate with respect to this first stage, as evidenced by the poor stabilities of formulations I and J when compared with, respectively, formulations B and H. This is unusual in light of the first-stage stabilities of formulations A, B, C, E, F, G and H.

TABLE I

EMULSION STABILITY DATA

| Component | Formulation (by parts) | | | | | | | | | | | | | | | | | | | | | |
|---|---|---|---|---|---|---|---|---|---|---|---|---|---|---|---|---|---|---|---|---|---|---|
| | A | B | C | D | E | F | G | H | I | J | K | L | M | N | O | P | Q | R | S | T | U | V |
| Fluorochemical Composition-1 | 4.63 | 5.0 | 5.0 | 5.0 | 5.0 | 5.0 | 6.0 | 7.0 | 5.0 | 7.0 | 5.0 | 5.0 | 5.0 | 5.0 | 5.0 | 5.0 | 5.0 | 5.0 | 5.0 | 5.0 | 6.0 | 7.0 |
| Nonhomogeneous Mixture-1[1] | 5.37 | — | — | — | — | — | — | — | — | — | — | — | — | — | — | — | — | — | — | — | — | — |
| Nonhomogeneous Mixture-2[2] | — | 5.0 | — | — | — | — | — | — | — | — | — | — | — | — | — | — | — | — | — | — | — | — |
| Nonhomogeneous Mixture-3[3] | — | — | 5.0 | — | — | — | — | — | — | — | — | — | — | — | — | — | — | — | — | — | — | — |
| Nonhomogeneous Mixture-4[4] | — | — | — | 5.0 | — | — | — | — | — | — | — | — | — | — | — | — | — | — | — | — | — | — |
| Alkanol Amide[5] | — | — | — | — | 5.0 | — | — | — | — | — | — | — | — | — | — | — | — | — | — | — | — | — |
| Aerosol OT-70-PG[6] | — | — | — | — | — | 5.0 | 4.0 | 3.0 | — | — | — | — | — | — | — | — | — | 2.5 | — | — | — | — |
| Nonhomogeneous Mixture-5[7] | — | — | — | — | — | — | — | — | 5.0 | — | — | — | — | — | — | — | — | — | — | — | — | — |
| Solution[8] | — | — | — | — | — | — | — | — | — | 3.0 | — | — | — | — | — | — | — | — | — | — | — | — |
| Aerosol OT-S[9] | — | — | — | — | — | — | — | — | — | — | 5.0 | — | — | — | — | 2.5 | 2.5 | — | — | — | — | — |
| Aerosol TR-70[10] | — | — | — | — | — | — | — | — | — | — | — | 5.0 | — | — | — | 2.5 | — | 2.5 | — | — | — | — |
| Aerosol GPG[11] | — | — | — | — | — | — | — | — | — | — | — | — | 5.0 | — | — | — | 2.5 | — | — | — | — | — |
| Aerosol AY[12] | — | — | — | — | — | — | — | — | — | — | — | — | — | 5.0 | — | — | — | — | — | — | — | — |
| Aerosol 1B[13] | — | — | — | — | — | — | — | — | — | — | — | — | — | — | 5.0 | — | — | — | — | — | — | — |
| Nekal WS-25[14] | — | — | — | — | — | — | — | — | — | — | — | — | — | — | — | — | — | — | 5.0 | — | — | — |
| Aerosol A-196 Extruded Modified[15] | — | — | — | — | — | — | — | — | — | — | — | — | — | — | — | — | — | — | — | 5.0 | 4.0 | 3.0 |
| POE(4)*POE*(4(16 Lauryl Ether | — | — | 5.0 | — | — | — | — | — | — | — | — | — | — | — | — | — | — | — | — | — | — | — |
| Tridecyl Alcohol + 5 Moles Ethylene Oxide, Phosphated, Potassium Salt | — | — | — | 4.0 | — | — | — | — | — | — | — | — | — | — | — | — | — | — | — | — | — | — |
| Coconut Oil | — | — | 5.0 | 6.0 | — | — | — | — | — | — | — | — | — | — | — | — | — | — | — | — | — | — |
| Water | 90.0 | 90.0 | 80.0 | 80.0 | 90.0 | 90.0 | 90.0 | 90.0 | 90.0 | 90.0 | 90.0 | 90.0 | 90.0 | 90.0 | 90.0 | 90.0 | 90.0 | 90.0 | 90.0 | 90.0 | 90.0 | 90.0 |
| Emulsion Stability* | | | | | | | | | | | | | | | | | | | | | | |

TABLE I-continued

EMULSION STABILITY DATA

| | Formulation (by parts) | | | | | | | | | | | | | | | | | | | | | |
|---|---|---|---|---|---|---|---|---|---|---|---|---|---|---|---|---|---|---|---|---|---|---|
| Component | A | B | C | D | E | F | G | H | I | J | K | L | M | N | O | P | Q | R | S | T | U | V |
| After 72 Hours | E | E | E | E | E | E | E | E | P | P | P | P | P | P | P | P | P | P | P | P | P | P |

[1]Consisting of 41.3 percent Nekal WS-25, 17.4 percent dimethyl naphthalene sodium sulfonate, and 41.3 percent ammonium perfluoroalkyl carboxylate.
[2]Consisting of 60 percent Nekal WS-25, 20 percent dimethyl naphthalene sodium sulfonate, and 20 percent ammonium perfluoroalkyl carboxylate.
[3]Consisting of 40 percent Nekal WS-25, 20 percent dimethyl naphthalene sodium sulfonate, and 40 percent ammonium perfluoroalkyl carboxylate.
[4]Consisting of 48 percent Nekal WS-25, 20 percent dimethyl naphthalene sodium sulfonate, and 32 percent ammonium perfluoroalkyl carboxylate.
[5]Alkanol amide resulting from reaction of coco fatty acid containing about 6 to 18 carbon atoms and diethanolamine.
[6]American Cyanamid's trade name for solution consisting of 70 percent sodium dioctyl sulfosuccinate, 16 percent propylene glycol, and 14 percent water.
[7]Consisting of approximately 60 percent sodium dioctyl sulfosuccinate, 20 percent dimethyl naphthalene sodium sulfonate, and 20 percent ammonium perfluoroalkyl carboxylate.
[8]Consisting of 70 percent Nekal WS-25, 16 percent propylene glycol, and 14 percent water.
[9]American Cyanamid's trade name for solution consisting of 70 percent dioctyl sulfosuccinate and 30 percent petroleum distillate.
[10]American Cyanamid's trade name for solution consisting of 70 percent sodium di(tridecyl($C_{13}$)) sulfosuccinate, 20 percent ethanol, and 10 percent water.
[11]American Cyanamid's trade name for solution consisting of 70 percent sodium dioctyl sulfosuccinate, 7 percent ethanol, and 23 percent water.
[12]American Cyanamid's trade name for waxy solid consisting of 100 percent sodium diamyl ($C_5$) sulfosuccinate.
[13]American Cyanamid's trade name for solution consisting of 45 percent sodium dibutyl ($C_4$) sulfosuccinate and 55 percent water.
*E = Excellent - no separation.
*P = Poor - separation.
[14]GAF's trade name for solution consisting of 75 percent sodium dinonyl sulfosuccinate, 10 percent isopropanol, and 15 percent water.
[15]Aerosol A-196 Extruded is American Cyanamid's trade name for a solid consisting of sodium di(cyclohexyl) sulfosuccinate. Modified - a solution is formed consisting of 70 percent sodium di(cyclohexyl)sulfosuccinate, 16 percent propylene glycol, and 14 percent water.
[16]Four moles of ethylene oxide per mole of lauryl alcohol.

EXAMPLE 5

The procedure of Example 1 was followed except that the 100 parts of the second noncontinuous phase which was added to Emulsion-1 consisted essentially of about 50 percent by weight of white mineral oil (350 SUS viscosity), about 48 percent by weight of sodium salt of polyoxyethylene oleyl phosphate containing about 7 moles of ethylene oxide per mole of oleyl alcohol, and about 2 percent by weight of sodium dinonyl sulfosuccinate. The resulting emulsion was stable for at least 3 days. For convenience, this emulsion is called Spin Finish-3.

EXAMPLE 6

The procedure of Example 2 is followed except that the 500 parts of the oil in water emulsion with which Emulsion-2 is blended contains 20 percent of an oil composition consisting essentially of about 50 percent by weight of white mineral oil (350 SUS viscosity), about 48 percent by weight of sodium salt of polyoxyethylene oleyl phosphate containing about 7 moles of ethylene oxide per mole of oleyl alcohol, and about 2 percent by weight of sodium dinonyl sulfosuccinate. The resulting emulsion is stable for at least 3 days. For convenience, this emulsion is called Spin Finish-4. Spin Finish-3 and Spin Finish-4 may be used in the same manner to coat yarn during an subsequent to spinning.

EXAMPLE 7

This example demonstrates use of Spin Finish-3 in a conventional spin-draw process for production of a polyamide yarn suitable for processing into bulked yarn that is oil repellent and resistant to soiling, especially by oily materials.

The procedure of Example 3 was followed with the substitution of Spin Finish-3 of Example 5 for Spin Finish-1. There was no separation of Spin Finish-3 in the finish circulation system. Bulked yarn made in accordance with this example had a mechanical quality rating of 4. Fabric made from polyamide yarn prepared in accordance with the present example had an oil repellency of 6.

EXAMPLE 8 (COMPARATIVE)

The procedure of Example 1 was followed except that the 100 parts of the second noncontinuous phase which was added to Emulsion-1 consisted essentially of about 60 percent by weight of refined coconut glyceride, about 30 percent by weight of polyoxyethylene hydrogenated castor oil containing about 16 moles of ethylene oxide per mole of hydrogenated castor oil, and about 10 percent by weight of potassium salt of polyoxyethylene tridecyl phosphate containing about 5 moles of ethylene oxide per mole of tridecyl alcohol. (Reference U.S. Pat. No. 4,126,564 to Marshall et al., hereby incorporated by reference). The resulting emulsion was stable for at least 15 days. For convenience, this emulsion is called Spin Finish-5.

EXAMPLE 9 (COMPARATIVE)

The procedure of Example 2 is followed except that the 500 parts of the oil in water emulsion with which Emulsion-2 is blended contains 20 percent of an oil composition consisting essentially of about 60 percent by weight of refined coconut glyceride, about 30 percent by weight of polyoxyethylene hydrogenated castor oil containing about 16 moles of ethylene oxide per mole of hydrogenated castor oil, and about 10 percent by weight of potassium salt of polyoxyethylene tridecyl phosphate containing about 5 moles of ethylene oxide per mole of tridecyl alcohol. The resulting emulsion is stable for at least 15 days. For convenience, this emulsion is called Spin Finish-6. Spin Finish-6 and Spin Finish-5 may be used in the same manner to coat yarn during and subsequent to spinning.

EXAMPLE 10 (COMPARATIVE)

This example demonstrates use of Spin Finish-5 in a conventional spin-draw process for production of a polyamide yarn suitable for processing into bulked yarn that is oil repellent and resistant to soiling, especially by oily materials.

The procedure of Example 3 was followed with the substitution of Spin Finish-5 of Example 8 for Spin Finish-1. There was no separation of Spin Finish-5 in the finish circulation system. Bulked yarn made in accordance with this example had a mechanical quality rating of 4. Fabric made from polyamide yarn prepared in accordance with the present example had an oil repellency of 1, due to the presence of hydrogenated castor oil.

EXAMPLE 11 (COMPARATIVE)

About 50 parts of Fluorochemical Composition-1 were added to a nonhomogeneous mixture consisting essentially of about 30 parts Nekal WS-25, 10 parts dimethyl naphthalene sodium sulfonate, and 10 parts ammonium perfluoroalkyl carboxylate. The mixture was heated to 80° C., at which temperature the Fluorochemical Composition-1 melted and formed a clear homogeneous mixture. It is believed that the isopropanol (of Nekal WS-25) vaporized. The oil was then added to 800 parts of water heated to about 80° C., and the mixture was agitated to form an emulsion which was then cooled to about 60° C. The oil particles in this emulsion had a particle size of less than one micron, and the emulsion was stable for more than 30 days without signs of separation. This emulsion was then blended with 100 parts of an oil composition consisting essentially of about 60 percent by weight of refined coconut glyceride, about 30 percent by weight of polyoxyethylene hydrogenated castor oil containing about 16 moles of ethylene oxide per mole of hydrogenated castor oil, and about 10 percent by weight of potassium salt of polyoxyethylene tridecyl phosphate containing about 5 moles of ethylene oxide per mole of tridecyl alcohol. The resulting emulsion was stable for at least 30 days. For convenience, this emulsion is called Spin Finish-7.

The procedure of Example 3 was followed with the substitution of Spin Finish-7 for Spin Finish-1. Spin Finish-7 gradually separated in the finish circulation system during commercial processing of the yarn and stopped the finish circulating pump. Bulked yarn made in accordance with this example prior to stoppage of the pump had a mechanical quality rating of 3. Fabric made from polyamide yarn prepared in accordance with this example (prior to pump stoppage) had an oil repellency of 1, due to the presence of hydrogenated castor oil.

EXAMPLE 12 (COMPARATIVE)

An initial emulsion was formed according to the procedure of Example 11. This emulsion was then blended with 100 parts of an oil composition (second noncontinuous phase) consisting essentially of about 59 percent by weight of coconut oil, about 15.5 percent by weight of polyoxyethlene castor oil containing about 25 moles of ethylene oxide per mole of castor oil, about 7.5 percent by weight of decaglycerol tetraoleate, about 3 percent by weight of glycerol monooleate, about 5 percent by weight of polyoxyethylene sorbitan monooleate containing about 20 moles of ethylene oxide per mole of sorbitan monooleate, and about 10 percent of weight of sulfonated petroleum product (reference U.S. Pat. No. 3,781,202 to Marshall et al., hereby incorporated by reference). The resulting emulsion separated and was not evaluated further.

EXAMPLE 13

About 50 parts of Fluorochemical Composition-1 were added to a nonhomogeneous mixture consisting essentially of about 20 parts Nekal WS-25, 10 parts dimethyl naphthalene sodium sulfonate, 20 parts ammonium perfluoralkyl carboxylate, 50 parts polyoxyethylene lauryl ether containing 4 moles of ethylene oxide per mole of lauryl alcohol, and 50 parts of coconut oil. The mixture was heated to 80° C., at which temperature the Fluorochemical Composition-1 melted and formed a clear homogeneous mixture. It is believed that the isopropanol (of Nekal WS-25) vaporized. This oil was then added to 800 parts of water heated to about 80° C., and the mixture was agitated to form an emulsion, which was then cooled to about 28° C. The oil particles in this emulsion had a particle size of less than 3 microns and the emulsion was stable for more than seven days without signs of separation. For convenience, this emulsion is called Spin Finish-8.

The procedure of Example 3 was followed with the substitution of Spin Finish-8 for Spin Finish-1. Spin Finish-8 separated in the finish circulation system during processing of the yarn and stopped the finish circulating pump. Bulked yarn made in accordance with this example prior to stoppage of the pump had a mechanical quality rating of 3. Fabric made from polyamide yarn prepared in accordance with this example (prior to pump stoppage) had an oil repellency of 5–6.

EXAMPLE 14

About 50 parts of Fluorochemical Composition-1 were added to a nonhomogeneous mixture consisting essentially of about 24 parts Nekal WS-25, 10 parts dimethyl naphthalene sodium sulfonate, 16 parts ammonium perfluroalkyl carboxylate, 60 parts of coconut oil, and 40 parts of potassium salt of polyoxyethylene tridecyl phosphate containing about 5 moles of ethylene oxide per mole of tridecyl alcohol. The mixture was heated to 90° C., at which temperature the Fluorochemcial Composition-1 melted and formed a clear homogeneous mixture. It is believed that the isopropanol (of Nekal WS-25) varporized. This oil was then added to 800 parts of water heated to about 90° C., and the mixture was agitated to form an emulsion, which was then cooled to about 28° C. The emulsion was stable for at least three days without signs of separation. For convenience, this emulsion is called Spin Finish-9.

The procedure of Example 3 was followed with the substitution of Spin Finish-9 for Spin Finish-1. Spin Finish-9 separated in the finish circulation system during processing of the yarn and stopped the finish circulating pump. Bulked yarn made in accordance with this example prior to stoppage of the pump had a poor mechanical quality rating. Fabric made from polyamide yarn prepared in accordance with this example (prior to pump stoppage) had excellent oil repellency.

EXAMPLE 15 (COMPARATIVE)

About 50 parts of Fluorochemical Composition-1 were added to 50 parts of an alkanol amide resulting from the reaction of coco fatty acid (containing about 6 to 18 carbon atoms) and diethanolamine, and the mixture was heated to 80° C. at which temperature the Fluorochemical Composition-1 melted and formed a clear homogeneous mixture. This oil was then added to 800 parts of water heated to about 80° C., and the mixture was agitated to form an emulsion, which was then cooled to about 60° C. The oil particles in this emulsion had a particle size of less than one micron, and the emulsion was stable for more than thirty days without signs of separation. This emulsion was then blended with 100 parts of an oil composition consisting of about 44.5 percent by weight of butyl stearate, about 27.75 percent by weight of sorbitan monooleate, and about 27.75 percent by weight of polyoxyethylene tallow amine containing about 20 moles of ethylene oxide per mole of tallow amine. (Reference U.S. Pat. No. 4,134,839 to Marshall). The resulting emulsion was stable for at least 30 days. For convenience, this emulsion is called Spin Finish-10.

The procedure of Example 3 was followed with the substitution of Spin Finish-10 for Spin Finish-1. Spin Finish-10 gradually separated in the finish circulation system during processing of the yarn and stopped the finish circulating pump. Bulked yarn made in accordance with this example prior to stoppage of the pump had a mechanical quality rating of 1. Fabric made from polyamide yarn prepared in accordance with this example (prior to pump stoppage) had an oil repellency of 6.

EXAMPLE 16 (COMPARATIVE)

About 70 parts of Fluorochemcial Composition-1 were added to 30 parts of a solution which consisted essentially of about 70 percent by weight of sodium dioctyl sulfosuccinate, about 16 percent by weight of propylene glycol and about 14 percent by weight of water. This solution is manufactured under the trade name of Aerosol OT-70-PG and obtainable from the American Cyanamid Company, Industrial Chemical Division, Process Chemicals Department, Wayne, N.J 07470. The Fluorochemcial Composition-1 and solution were heated to 80° C., at which temperature the Fluorochemcial Composition-1 melted and formed a clear homogeneous first noncontinuous phase. This first noncontinuous phase was then added to 800 parts of water heated to about 80° C., and the mixture was agitated to form an emulsion, which was then cooled to about 60° C. The oil particles in this emulsion had a particle size of less than one micron, and the emulsion was stable for at least 30 days without signs of separation. This emulsion was then blended with 100 parts of a second noncontinuous phase consisting essentially of about 55 percent by weight of coconut oil, about 25 percent by weight of polyoxyethylene oleyl ether containing about 10 moles of ethylene oxide per mole of oleyl alcohol, about 5 percent by weight of polyoxyethylene nonyl phenol containing about 9 moles of ethylene oxide per mole of nonyl phenol, and about 15 percent by weight of polyoxyethylene stearate containing about 8 moles of ethylene oxide per mole of stearic acid. The resulting emulsion was stable for at least 30 days. For convenience, this emulsion is called Spin Finish-11.

The procedure of Example 3 was followed with the substitution of Spin Finish-11 for Spin Finish-1 There was no separation of Spin Finish-11 in the finish circulation system. Bulked yarn made in accordance with this example had a mechanical quality rating of 5. Fabric made from polyamide yarn prepared in accordance with this example had an oil repellency of 5–6.

EXAMPLE 17 (COMPARATIVE)

An initial emulsion was prepared according to the procedure of Example 16. This emulsion was then blended with 100 parts of the oil composition (second noncontinuous phase) of Example 12. The resulting emulsion separated and was not further evaluated.

EXAMPLE 18 (COMPARATIVE)

An initial emulsion was prepared according to the procedure of Example 16. This emulsion was then blended with 100 parts of the oil composition (second noncontinuous phase) of Example 8. The resulting emulsion separated and was not further evaluated.

EXAMPLE 19 (CONTROL-1)

The procedure of Example 3 is followed except that the spin finish of U.S. Pat. No. 4,126,564 was substituted for Spin Finish-1. Bulked yarn made in accordance with this example had a mechanical quality rating of 5. Fabric made from polyamide yarn prepared in accordance with this example had an oil repellency of zero.

EXAMPLE 20 (CONTROL-2)

The procedure of Example 3 is followed except that the spin finish of U.S. Pat. No. 3,781,202 is substituted for Spin Finish-1. Bulked yarn made in accordance with this example has an acceptable mechanical quality rating. However, fabric made from polyamide yarn prepared in accordance with this example is not oil repellent.

EXAMPLES 21–34

About 50 parts of Fluorochemical Composition-1 are added to 50 parts of a nonhomogeneous mixture which consists essentially of about 60 percent by weight of Nekal WS-25, about 20 percent by weight of dimethyl naphthalene sodium sulfonate and about 20 percent by weight of ammonium perfluoroalkyl carboxylate. The Fluorochemical Composition-1 and nonhomogeneous mixture are heated to 80° C., at which temperature the Fluorochemical Composition-1 melts and forms a clear homogeneous noncontinuous phase. It is believed that the isopropanol (of Nekal WS-25) vaporizes. This noncontinuous phase is then added to 900 parts of water which has been heated to about 80° C., and the mixture is agitated to form an emulsion, which is then cooled to room temperature (about 28° C.). The oil particles in this emulsion have a particle size of less than one micron, and the emulsion is stable for at least 30 days without signs of separation. For convenience, this emulsion is called Emulsion-3.

EXAMPLE 21 (COMPARATIVE)

Polyamide polymer pellets prepared in accordance, generally, with the procedure set forth in Example 3, are melted at about 285° C. and are melt extruded under pressure of about 1,500 psig. through a 70-orifice spinnerette to produce an undrawn yarn having about 3,600 denier. Emulsion-3 is applied to the yarn via a first kiss roll in amount to provide about 0.35 percent by weight of oil on the yarn. A spin finish is applied to the yarn via a second kiss roll immediately subsequent to application of Emulsion-3, in amount to provide about 0.8 percent by weight of oil on the yarn. The spin finish applied by the second kiss roll is an oil in water emulsion of about 20 percent by weight of the roll portion. The oil consists essentially of about 60 percent by weight of refined coconut glyceride, about 30 percent by weight of polyoxyethylene hydrogenated castor oil containing about 16 moles of ethylene oxide per mole of hydrogenated castor oil, and about 10 percent by weight of potassium salt of polyoxyethylene tridecyl phosphate containing about 5 moles of ethylene oxide per mole of tridecyl alcohol. The yarn is then drawn at about 3.2 times the extruded length and textured with a steam jet at a temperature of 140° C. to 180° C. to produce a bulked yarn that is particularly useful for production of carpets and upholstery fabrics.

The bulked yarn is visually inspected for mechanical quality after spinning and steam jet texturing as outlined in Example 3. Bulked yarn made in accordance with this example has an acceptable mechanical quality rating.

The bulked yarn is made into a fabric by conventional means and is evaluated for oil repellency by AATCC Test No. 118-1975, as set forth in Example 3. The fabric made from polyamide yarn prepared in accordance with the present example is not oil repellent, due to the presence of hydrogenated castor oil.

EXAMPLE 22 (COMPARATIVE)

The procedure of Example 21 is followed except that the spin finish is applied via the first kiss roll and Emulsion-3 is applied via the second kiss roll. The yarn mechanical quality rating and fabric oil repellency value are similar to Example 21.

EXAMPLES 23–24

The procedure of Example 21 is followed except that the oil portion of the spin finish consists of about 44.5 percent by weight of butyl stearate, about 27.75 percent by weight of sorbitan monooleate, and about 27.75 percent by weight of polyoxyethylene tallow amine containing about 20 moles of ethylene oxide per mole of tallow amine. In Example 23, the spin finish is applied via the second kiss roll, and in Example 24, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 25–26

The procedure of Example 21 is followed except that the oil portion of the spin finish consists of about 55 percent by weight of mineral oil, about 11 percent by weight of a fatty acid soap, about 15 percent by weight of a sulfonated ester ethoxylate, about 12 percent by weight of polyethylene glycol ester, about 6 percent by weight of polyethylene glycol ether, and about 1 percent by weight of triethanolamine. In Example 25, the spin finish is applied via the second kiss roll, and in Example 26, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 27–28

The procedure of Example 21 is followed except that the oil portion of the spin finish consists of about 55 percent by weight of coconut oil, about 25 percent by weight of polyoxyethylene oleyl ether contaning about 10 moles of ethylene oxide per mole of oleyl alcohol, about 5 percent by weight of polyoxyethylene oleate containing about 5 moles of ethylene oxide per mole of oleic acid, and about 15 percent by weight of polyoxyethylene castor oil containing about 5 moles of ethylene oxide per mole os castor oil. In Example 27, the spin finish is applied via the second kiss roll, and in Example 28, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 29–30

The procedure of Example 21 is followed except that the oil portion of the spin finish consists of about 59 percent by weight of coconut oil, about 15.5 percent by weight of polyoxyethylene castor oil containing about 25 moles of ethylene oxide per mole of castor oil, about 7.5 percent by weight of decaglycerol tetraoleate, about 3 percent by weight of glycerol monooleate, about 5 percent by weight of polyoxyethylene sorbitan monooleate containing about 20 moles of ethylene oxide per mole of sorbitan monooleate and about 10 percent by weight of sulfonated petroleum product. In Example 29, the spin finish is applied via the second kiss roll, and in Example 30, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 31–32

The procedure of Example 21 is followed except that the oil portion of the spin finish consists of about 55 percent by weight of coconut oil, about 25 percent by weight of polyoxyethylene oleyl ether containing about 10 moles of ethylene oxide per mole of oleyl alcohol, about 5 percent by weight of polyoxyethylene nonyl phenol containing about 9 moles of ethylene oxide per mole of nonyl phenol, and about 15 percent by weight of polyoxyethylene stearate containing about 8 moles of ethylene oxide per mole of stearic acid. In Example 31, the spin finish is applied via the second kiss roll, and in Example 32, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLES 33–34

The procedure of Example 21 is followed except that the oil portion of the spin finish consists of about 50 percent by weight of white mineral oil (350 SUS viscosity), about 48 percent by weight of sodium salt of polyoxyethylene oleyl phosphate containing about 7 moles of ethylene oxide per mole of oleyl alcohol, and about 2 percent by weight of sodium dinonyl sulfosuccinate. In Example 33, the spin finish is applied via the second kiss roll, and in Example 32, the spin finish is applied via the first kiss roll. Bulked yarn made in accordance with each of these examples has an acceptable mechanical quality rating. Fabric made from polyamide yarn prepared in accordance with each of these examples is oil repellent.

EXAMPLE 35

Polyethylene terephthalate pellets are melted at about 290° C. and are melt extruded under a pressure of about 2500 psig. through a 34-orifice spinnerette to produce a partially oriented yarn having about 250 denier. Spin Finish-1 of Example 1 is applied to the yarn as a spin finish via a kiss roll in amount to provide about 0.6 percent by weight of oil on the yarn. The yarn is then draw-textured at about 1.3 times the extruded length and at a temperature of 150° C. to 175° C. to produce a bulked yarn having a drawn denier of about 150. Yarn produced in this manner is particularly useful for production of carpets and fine apparel. Bulked yarn made in accordance with this example has an acceptable mechanical quality rating. In accordance with the procedure of Example 3, the bulked yarn of this example is made into fabric for evaluation of oil repellency. Fabric so produced is oil repellent.

EXAMPLES 36–37

The procedure of Example 35 is followed except that in lieu of Spin Finish-1 are substituted Spin Finish-3 of Example 5 and Spin Finish-5 of Example 8 in each of, respectively, Examples 36 and 37. Bulked yarn made in accordance with each of these examples has an acceptable mechanical quality rating. Fabric made from polyethylene terephthalate yarn prepared in accordance with Example 36 is oil repellent while yarn prepared in accordance with Example 37 is not oil repellent.

EXAMPLE 38 (COMPARATIVE)

Polyethylene terephthalate pellets are melted at about 290° C. and are melt extruded under a pressure of about 2500 psig. through a 34-orifice spinnerette to produce a partially oriented yarn having about 250 denier. Emulsion-3 (of Examples 21–34) is applied to the yarn via a first kiss roll, and the spin finish of Example 21 is applied to the yarn via a second kiss roll immediately subsequent to application of Emulsion-3, in amount to provide a total of about 0.6 percent by weight of oil on the yarn. The yarn is then draw-textured at about 1.3 times the extruded length and at a temperature of 150° C. to 175° C. to produce a bulked yarn having a drawn denier of about 150. Yarn produced in this manner is particularly useful for production of carpets and fine apparel. Bulked yarn made in accordance with this example has an acceptable mechanical quality rating. In accordance with the produce of Example 3, the bulked yarn of this example is made into fabric for evaluation of oil repellency. Fabric so produced is not oil repellent, due to the presence of hydrogenated castor oil.

EXAMPLE 39 (COMPARATIVE)

The procedure of Example 38 is followed except that the spin finish is applied via the first kiss roll and Emulsion-3 is applied via the second kiss roll. The yarn mechanical quality rating is acceptable; however, the fabric is not oil repellent.

EXAMPLES 40–41

The procedure of Example 38 is followed except that the oil portion of the spin finish is as set forth in Examples 23–24. In Example 40, the spin finish is applied via the second kiss roll, and in Example 41, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLES 42–43

The procedure of Example 38 is followed except that the oil portion of the spin finish is as set forth in Examples 25–26. In Example 42, the spin finish is applied via the second kiss roll, and in Example 43, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLES 44–45

The procedure of Example 38 is followed except that the oil portion of the spin finish is as set forth in Exmples 27–28. In Example 44, the spin finish is applied via the second kiss roll, and in Example 45, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLES 46–47

The procedure of Example 38 is followed except that the oil portion of the spin finish is as set forth in Examples 29–30. In Example 46, the spin finish is applied via the second kiss roll, and in Example 47, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLES 48–49

The procedure of Example 38 is followed except that the oil portion of the spin finish is as set forth in Examples 31–32. In Example 48, the spin finish is applied via the second kiss roll, and in Example 49, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLES 50–51

The procedure of Example 38 is followed except that the oil portion of the spin finish is as set forth in Examples 33–34. In Example 50, the spin finish is applied via the second kiss roll, and in Example 51, the spin finish is applied via the first kiss roll. Bulked yarn made in accordance with each of these examples has an acceptable mechanical quality rating. Fabric made from polyethylene terephthalate yarn prepared in accordance with each of these examples is oil repellent.

EXAMPLE 52

About 46.3 parts of Fluorochemical Composition-1 are added to 53.7 parts of the nonhomogeneous mixture of Example 1, and the two are heated to 80° C., at which temperature the Fluorochemical Composition melts and forms a clear homogeneous yarn finish composition. This composition is sprayed onto 7-inch polyamide staple fiber, which has a denier per filament of 17 and which is produced by a conventional spinning and staple processing operation, prior to baling. The yarn is subsequently heat set and made into carpet by conventional means. Carpet made in accordance with this example is oil repellent.

EXAMPLE 53

The procedure of Example 52 is followed except that the yarn is polyethylene terephthalate staple fiber which has a denier per filament of 12. Carpet made in accordance with this procedure is also oil repellent.

EXAMPLE 54

Polyamide woven fibric is dipped into a pad box containing Emulsion-3 of Examples 21–34 diluted to 1 percent solids. The fabric is squeezed between a steel and a hard rubber roll with sufficient pressure to obtain a 50 percent wet pickup on the weight of the fabric. The fabric is then cured for 1 minute at 150° C. in a circulating air oven. The fluorine content of the finished fabric is 0.17 percent. This is Sample Number 1. This procedure is repeated, utilizing a polyethylene terephthalate fabric, which is Sample Number 2. After a standard home laundering, the oil repellency of both Sample Numbers 1 and 2, as measured by AATCC Test No. 118-1975 set forth in Example 3, is 6.

EXAMPLE 55

The procedure of Example 1 is followed except that in forming the first noncontinuous phase, 50 parts of Fluorochemcial Composition-1 are added to 50 parts of the nonhomogeneous mixture. The resulting emulsion is called Spin Finish-12. The procedure of Example 3 is then followed with substitution of Spin Finish-12 for Spin Finish-1. Spin Finish-12 gradually separates in the finish circulation system during commercial processing of the yarn and stops the finish circulating pump. Bulked yarn made in accordance with this example prior to stoppage of the pump has an acceptable mechanical quality rating. Fabric made from polyamide yarn prepared in accordance with this example (prior to pump stoppage) is oil repellent.

DISCUSSION

As the preceding examples illustrate, the yarn finish composition of the present invention renders synthetic organic polymer yarn and/or yarn products with which it is incorporated oil repellent and resistant to soiling. Further, emulsions and spin finishes which include the aforementioned yarn finish composition exhibit exceptional emulsion stability for incorporation with synthetic organic polymer yarn and/or yarn products to achieve the same beneficial results. The examples which show little or no increase in soil repellency by virtue of utilizing the present invention in one of these forms, i.e., Examples 10, 11, 21, 22, 37, 38 and 39, have as a common spin finish componenet hydrogenated castor oil, the presence of which has been found to seriously diminish oil repellency.

In Example 4, there were defined three critical stages for emulsion stability. Example 4 demonstrated the excellent emulsion stability of the initial oil in water emulsion of the present invention. Examples 1, 2, 5, 6, 8, 9, 11, 13, 14, 15 and 16 demonstrate the second stage emulsion stability of, respectively, Spin Finishes -1,-2,-3,-4,-5,-6,-7,-8,-9,-10,and -11. Further examination of Examples 11, 13, 14, and 15 shows that each of their respective Spin Finishes (-7,-8,-9and-10) gradually separates at the third stage, i.e., in the finish circulation system at the finish circulating pump. A comparison of Spin Finishes -5 and -7 of, respectively, Examples 8 and 11, demonstrates the criticality of proportions of the Fluorochemical Composition-1 and nonhomogeneous mixture to third stage stability. However, application of the yarn finish composition (consisting essentially of these components) to yarn to some method not requiring third stage stability, e.g., by tandem kiss rolls, spraying, padding, etc., still effectively renders the yarn and yarn products oil repellent and resistant to soiling. In this regard, it should be noted that Spin Finish-10 of Example 15 is the subject of commonly assigned U.S. Pat. No. 4,134,839, and Spin Finish-11 of Example 16 is the subject of commonly assigned U.S. Application Ser. No. 974,203, filed Dec. 28, 1978.

What is claimed is:

1. A yarn finish composition comprising:

a. about 15 to 80 weight percent of a nonhomogeneous mixture of a salt of dinonyl sulfosuccinate, a salt dimethyl naphthalene sulfonate, and ammonium perfluoralkyl carboxylate, and b. about 20 to 85 weight percent of a fluorochemical compound having the formula

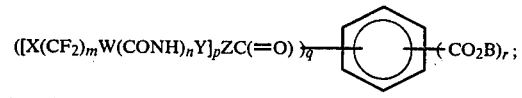

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1 or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than g; and $X(CF_2)_m$, W and Y are straight chains, branched chains or cyclic; and wherein the substituent chains of the above general formulas are the same or different.

2. An emulsion of water and approximately 5 to 25 percent by weight of said emulsion of said composition as defined in claim 1.

3. The composition of claim 1 wherein the fluorochemical compound is a trimellitate, a pyromellitate, or a bis(diamide)/ester of trimellitic acid or pyromellitic acid, wherein each fluorinated radical, of formula $X(CF_2)_mW(CONH)_nY$, has a main chain containing at least six carbon atoms and contains at least four perfluorinated carbon atoms in the radical.

4. The composition of claim 1 wherein the fluorochemical compound is a mixture of pyromellitates having the structure:

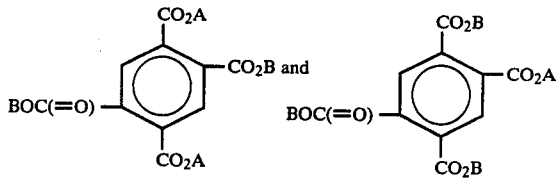

(a) para (50%) (b) meta (50%)

A = $(CH_2)_2(CF_2)_nCF_3$ where n is 5–13

B = $CH_2CHOHCH_2Cl$.

5. The composition of claim 1 wherein said nonhomogeneous mixture consists essentially of about 20 to 60 percent by weight of the salt of dinonyl sulfosuccinate, about 5 to 23 percent by weight of the salt of dimethyl naphthalene sulfonate, and about 17 to 60 percent by weight of ammonium perfluoroalkyl carboxylate.

6. The composition of claim 1 wherein said nonhomogeneous mixture consists essentially of about 41.3 percent by weight of the salt of dinonyl sulfosuccinate, about 17.4 percent by weight of the salt of dimethyl naphthalene sulfonate and about 41.3 percent by weight of ammonium perfluoroalkyl carboxylate.

7. A polyamide yarn having incoporated therewith the composition of claim 1.

8. A polyester yarn having incoporated therewith the composition of claim 1.

9. The polyamide yarn product having incorporated therewith the composition of claim 1.

10. The polyester yarn product having incorporated therewith the composition of claim 1.

11. The composition of claim 1 wherein the salt of dinonyl sulfosuccinate is an ammonium dinonyl sulfosuccinate.

12. The composition of claim 1 wherein the salt of dinonyl sulfosuccinate is an alkali metal dinonyl sulfosuccinate.

13. The composition of claim 12 wherein the alkali metal dinonyl sulfosuccinate is sodium dinonyl sulfosuccinate.

14. The composition of claim 1 wherein the salt of dimethyl naphthalene sulfonate is an ammonium dimethyl naphthalene sulfonate.

15. The composition of claim 1 wherein the salt of dimethyl naphthalene sulfonate is an alkali metal dimethyl naphthalene sulfonate.

16. The composition of claim 15 wherein the alkali metal dimethyl naphthalene sulfonate is dimethyl naphthalene sodium sulfonate.

* * * * *